US006832442B2

(12) United States Patent
Lewis et al.

(10) Patent No.: US 6,832,442 B2
(45) Date of Patent: Dec. 21, 2004

(54) ADJUSTABLY SIZABLE AND PROTECTIVE BOOT

(75) Inventors: Patricia Lewis, Huber Heights, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 48 days.

(21) Appl. No.: 10/078,068

(22) Filed: Feb. 19, 2002

(65) Prior Publication Data

US 2003/0154630 A1 Aug. 21, 2003

(51) Int. Cl.[7] ..... A43B 3/26; A43B 1/02
(52) U.S. Cl. ..... 36/97; 36/7.1 R; 36/9 R
(58) Field of Search ..... 36/97, 7.1 R, 9 R, 36/9 A

(56) References Cited

U.S. PATENT DOCUMENTS 1,748,607 A * 2/1930 Jarrett ..... 36/1
2,391,720 A * 12/1945 Ludwig ..... 36/97
2,603,889 A * 7/1952 Lahnstein et al. ..... 36/112
2,630,636 A * 3/1953 Cockrell ..... 36/11
3,268,767 A * 8/1966 Saraceni et al. ..... 361/223
3,337,770 A * 8/1967 Saraceni et al. ..... 361/223
3,618,235 A * 11/1971 Cary, Jr. ..... 36/97
3,744,163 A * 7/1973 Simister ..... 36/97
3,769,722 A * 11/1973 Rhee ..... 36/2 R
4,178,703 A * 12/1979 Pols ..... 36/110
4,458,431 A * 7/1984 Sinclair ..... 36/88
4,599,811 A * 7/1986 Rousseau ..... 36/105
4,788,780 A * 12/1988 Boggs ..... 36/7.1 R
5,469,637 A * 11/1995 Adam ..... 36/2 R
5,495,828 A * 3/1996 Solomon et al. ..... 119/850

* cited by examiner

*Primary Examiner*—M. D. Patterson
(74) *Attorney, Agent, or Firm*—Wood, Phillips, Katz, Clark & Mortimer

(57) ABSTRACT

A protective boot made from a foldable material such as Nomex™ material or Kevlar™ material or, for some applications, such as neoprene has an ankle-covering portion and a foot-covering portion, which has a heel end and a toe end. Near the toe end, the foot-covering portion is foldable onto itself and is fastenable to itself when and where folded onto itself, whereby the foot-covering portion can be adjustably sized. Hook-and-loop fasteners, which are preferred, or other fasteners are used for fastening the foot-covering portion releasably to itself when and where folded onto itself, at any one of plural positions. Hook-and-loop fasteners, if used therefor, enable the foot-covering portion to be releasably fastened to itself when and where folded onto itself, at any position within a range of possible positions. The protective boot has two hook-and-loop straps, each drawn around the protective boot and fastened to itself and to said fastening means. One such strap is drawn around the foot-covering portion, between the toe end and the ankle-covering portion, and the other strap is drawn around the ankle-covering portion.

3 Claims, 2 Drawing Sheets

ADJUSTABLY SIZABLE AND PROTECTIVE BOOT

TECHNICAL FIELD OF THE INVENTION

This invention pertains to a protective boot, which is wearable over a shoe or a boot by a person, such as a firefighter or an emergency worker, who risks being exposed to hazardous materials, and which is designed to be adjustably sized in a novel manner.

BACKGROUND OF THE INVENTION

Commonly, a person, such as a firefighter or an emergency worker, who risks being exposed to hazardous materials, wears a protective suit, which fully encapsulates the arms, legs, and torso of the person, and protective boots, which are worn over conventional shoes or conventional boots.

For each wearer, the protective boots must be properly sized, so as fit without being so oversized as to become tripping hazards. Heretofore, agencies employing firefighters or emergency workers have needed to stock protective boots in different sizes, so as to accommodate wearers having differently sized feet.

SUMMARY OF THE INVENTION

This invention provides a protective boot, which is wearable over a shoe or a boot, which is made from a foldable material, and which has an ankle-covering portion and a foot-covering portion. The foot-covering portion having a heel end and a toe end. Near the toe end, the foot-covering portion is fastenable, whereby the foot-covering portion can be adjustably sized.

Preferably, the foot-covering portion is foldable onto itself near the toe end and is fastenable to itself when and where folded onto itself fastenable, whereby the foot-covering portion can be adjustably sized. Preferably, moreover, the foot-covering portion is fastenable releasably to itself. Preferably, the protective boot has means for fastening the foot-covering portion to itself when and where folded onto itself. Preferably, moreover, the protective boot has means for fastening the foot-covering portion releasably to itself.

In a preferred embodiment, hook-and-loop fastening means (e.g., Velcro™ fasteners) are used for fastening the foot-covering portion releasably to itself when and where folded onto itself, at any position within a range of possible positions. Hook-and-loop fasteners, if used therefor, enable the foot-covering portion to be releasably fastened to itself when and where folded onto itself, at any position within a range of possible positions. Other fastening means, such as a snap fastener, a set of snap-fasteners, or lacing, may be alternatively used.

The protective boot may have a hook-and-loop strap drawn around the protective boot and fastened to itself and to said fastening means. Preferably, the protective boot has two hook-and-loop straps, each drawn around the protective boot and fastened to itself and to said fastening means. Preferably, moreover, one said strap is drawn around the foot-covering portion, between the toe end and the ankle-covering portion, and the other strap is drawn around the ankle-covering portion.

DETAILED DESCRIPTION OF THE ILLUSTRATED EMBODIMENTS

Figure 1:
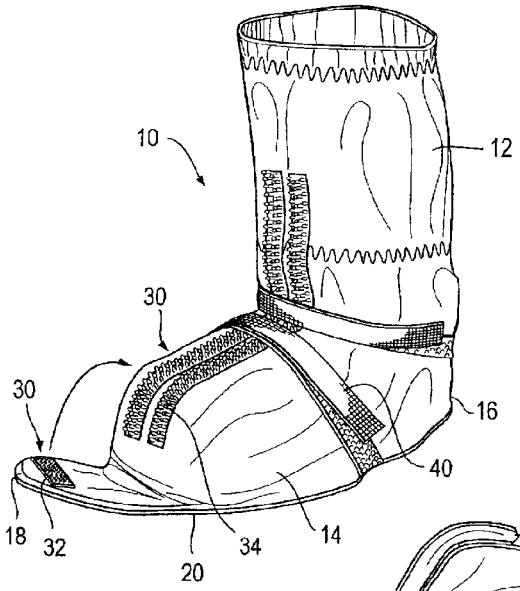
FIG. 1 is a side, perspective view of a protective boot constituting a preferred embodiment of this invention and being worn by a wearer, such as a firefighter or an emergency worker, before a foot-covering portion of the protective boot is being folded up, back, and onto itself, near a toe end of the foot-covering portion.

As illustrated in FIGS. 1 through 4, a protective boot 10 constituting a preferred embodiment of this invention and being worn by a wearer, such as a firefighter or an emergency worker, is made from a foldable material, such as Nomex™ material or Kevlar™ material, which conforms to applicable standards of the National Fire Protection Association (NFPA) or other standards-setting organizations. For some applications, a foldable material such as neoprene may be alternatively used.

The protective boot 10 has an ankle-covering portion 12 and a foot-covering portion 14. The foot-covering portion 14 has a heel end 16 and a toe end 18. Near the toe end 18, the foot-covering portion 14 is foldable up, back, and onto itself and is fastenable releasably to itself when and where folded onto itself, whereby the foot-covering portion 14 can be adjustably sized in its toe-to-heel length. The protective boot 10 is provided with a wear-resistant sole 20, which is made from another, suitable material and which adheres to the foot-covering portion 14 via a suitable adhesive.

As illustrated in the Figures, particularly FIG. 1, the foot-covering portion 14 and the ankle-covering portion 12 together define a closed pouch allowing entry into the protective boot 10 only through an opening in the ankle-covering portion 12.

As preferred means for fastening the foot-covering portion releasably to itself when and where folded onto itself, the protective boot 10 has hook-and-loop fastening means 30 (e.g., Velcro™ fasteners) which comprise a hook-faced patch 32 adhering to the toe end 18 and two loop-faced strips 34 adhering to the foot-covering portion 14, between the toe end 18 and the ankle-covering portion 12, and which are used to fasten the foot-covering portion 14 releasably to itself when and where folded onto itself, at any position within a range of possible positions.

As illustrated in FIG. 1, before the foot-covering portion 14 is folded onto itself, the loop-faced strips 34 are spaced from the hook-faced patch 22. A suitable adhesive is used to cause the hook-faced patch 32 to adhere to the toe end 18 and to cause the loop-faced strips 34 to adhere to the foot-covering portion 14, between the toe end 18 and the ankle-covering portion 12.

Figure 2:
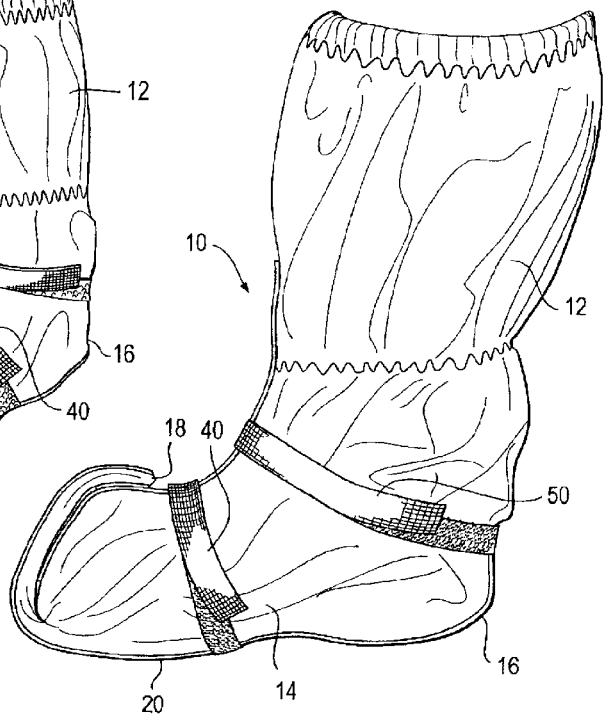
FIG. 2 is a side, perspective view thereof
Figure 3:
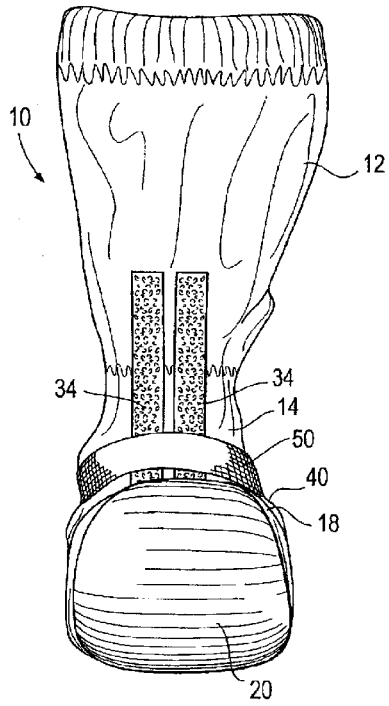
FIG. 3 is a front, perspective view thereof, after the foot-covering portion has been folded up, back, and onto itself and has been fastened releasably to itself, via hook-and-loop fastening means.
Figure 4:
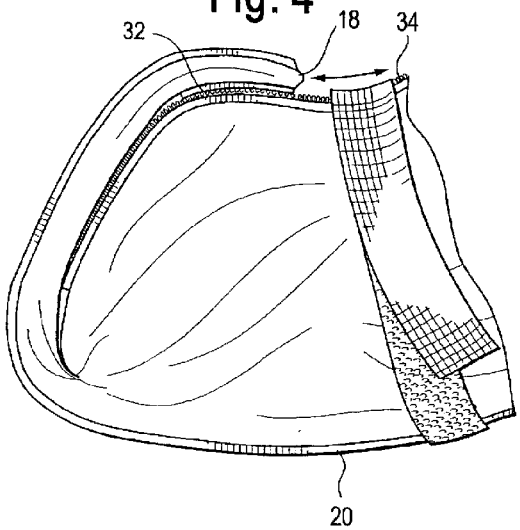
FIG. 4 is an enlarged detail, which is taken from FIG. 2.

As illustrated in FIGS. 1, 2, and 3, two hook-and-loop straps are drawn around the protective boot 10 and are fastened releasably to themselves and to the loop-faced strips 34, one such strap 40 being drawn around the foot-covering portion 14, between the toe end 16 and the ankle-covering portion 12, and the other strap 50 being drawn around the ankle-covering portion 12. Each hook-and-loop strap 40, 50, has a hook-faced portion, which fastens releasably to the loop-faced strips 34, and a loop-faced portion, which fastens releasably to the hook-faced portion. Thus, where the hook-and-loop straps 40, 50, are drawn around the protective boot 10, the hook-and-loop straps 40, 50, compensate for any looseness in the foldable material of the protective boot 10.

Figure 5:
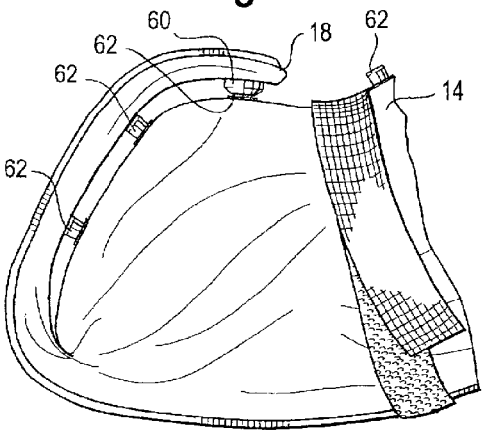
FIGS. 5, 6, 7, and 8 are analogous details, which illustrate the protective boot with alternative fastening means.

In FIG. 5, an alternative embodiment is illustrated, in which a set of snap fasteners are used, rather than the hook-and-loop fastening means 30. A fastener part 60 defining a socket is fastened to the toe end 18 and several fastener parts 62 defining plugs, which are adapted to be snap-fitted into the socket defined by the fastener part 60, are fastened to the foot-covering portion 14, between the toe end 18 and the ankle-covering portion 12. The fastener 60 defining the socket is snapped releasably onto a selected one of the fasteners 62 defining plugs.

Figure 6:
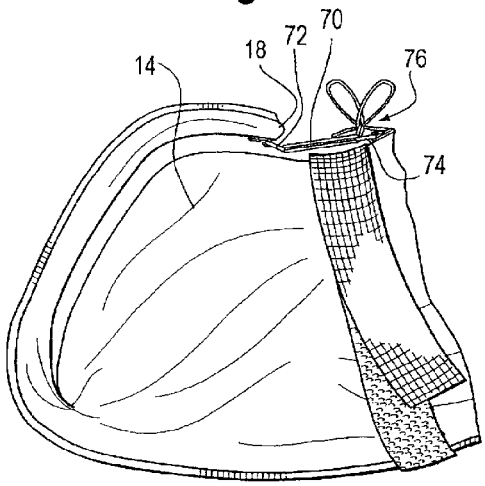

In FIG. 6, an alternative embodiment is illustrated, in which a lace 70 is used, rather than the hook-and-loop fastening means 30. The lace 70 is passed through a metal ring 72, which is fastened to the toe end 16, and through a metal ring 74, which is fastened to the foot-covering portion 14, between the toe end 18 and the ankle-covering portion 12, and is tied with a releasable knot 76.

Figure 7:
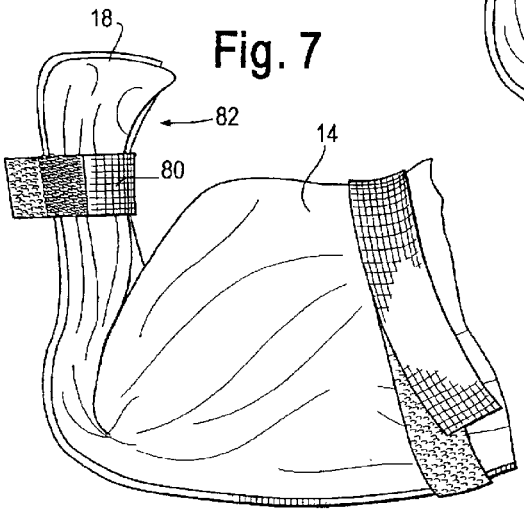

In FIG. 7, an alternative embodiment is illustrated, in which a hook-and-loop strap 80 having a hook-faced portion and a loop-faced portion is used, rather than the hook-and-loop fastening means 30. Near the toe end 18, the foot-covering portion 14 is drawn into a tight bundle 82 and is fastened in the tight bundle 82 via the hook-and-loop strap 80, which is drawn around the tight bundle 82 and which is fastened to itself via its hook-faced and loop-faced portions.

Figure 8:
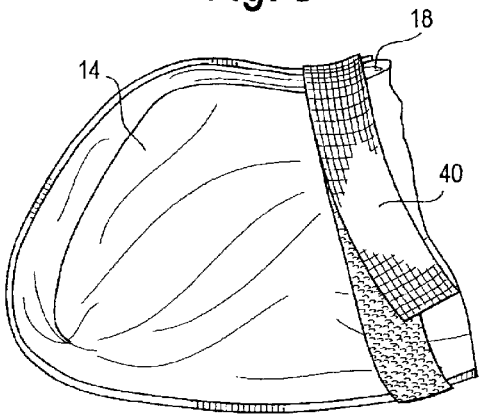

In FIG. 8, an alternative embodiment is disclosed, in which the hook-and-loop fastening means 30 is not used. Rather, the toe end 18 of the foot-covering portion 14 is tucked under the hook-and-loop strap 40, whereby the foot-covering portion 14 is fastened releasably to itself when the hook-and-loop strap 40 is drawn tightly and is fastened to itself.

What is claimed is:

1. An adjustably sizeable, protective boot wearable over a shoe or a boot and made from a foldable material, the protective boot having an ankle-covering portion and a foot-covering portion, the foot-covering portion having a toe end, the foot-covering portion being foldable onto itself near the toe end and being fastenable releasably to itself when and where folded onto itself, so as to be adjustably sizable, wherein the protective boot has a hook-and-loop fastener, which has a hook-faced member and a loop-faced member, one said member adhering to the foot-covering portion, between the toe end and the ankle-covering portion, the other member adhering to the toe end and being fastenable releasably to said one member adhering to the foot-covering portion, and wherein the protective boot has a hook-and-loop strap, which is drawn around the protective boot and which is fastened releasable to itself and to said one member adhering to the foot-covering portion.

2. The protective boot of claim 1, wherein the hook-and-loop strap is one of two hook-and-loop straps, each of which is drawn around the protective boot and each of which is fastened releasable to itself and to said one member adhering to the foot-covering portion.

3. The protective boot of claim 2, wherein one said strap is drawn around the ankle-covering portion and wherein the other strap is drawn around the foot-covering portion.

* * * * *